US011279534B2

(12) United States Patent
Murphy

(10) Patent No.: US 11,279,534 B2
(45) Date of Patent: Mar. 22, 2022

(54) TAMPER-EVIDENT PLASTIC CONTAINER

(71) Applicant: PACTIV LLC, Lake Forest, IL (US)

(72) Inventor: Brian M. Murphy, Chicago, IL (US)

(73) Assignee: PACTIV LLC, Lake Forest, IL (US)

( * ) Notice: Subject to any disclaimer, the term of this patent is extended or adjusted under 35 U.S.C. 154(b) by 67 days.

(21) Appl. No.: 16/385,145

(22) Filed: Apr. 16, 2019

(65) Prior Publication Data

US 2020/0331674 A1 Oct. 22, 2020

(51) Int. Cl.

*B65D 55/02* (2006.01)
*B65D 43/02* (2006.01)
*B65D 43/16* (2006.01)

(52) U.S. Cl.

CPC ..... *B65D 55/024* (2013.01); *B65D 43/0237* (2013.01); *B65D 43/162* (2013.01); *B65D 2543/00194* (2013.01); *B65D 2543/00296* (2013.01)

(58) Field of Classification Search

CPC ..... B65D 55/024; B65D 43/162; B65D 43/0237; B65D 2543/00194; B65D 2543/00296

USPC .... 220/4.23, 23.86, 265–266, 269–270, 377, 220/791, 836

See application file for complete search history.

(56) References Cited

U.S. PATENT DOCUMENTS 3,059,830 A * 10/1962 Kramer ..... B65D 5/5016 206/418
3,693,866 A * 9/1972 Struble ..... B65D 5/5016 206/591
5,041,317 A * 8/1991 Greyvenstein ..... B65D 33/002 428/35.5
5,046,659 A 9/1991 Warburton
5,131,551 A 7/1992 Wells
5,507,406 A 4/1996 Urciuoli et al.
5,584,408 A 12/1996 Orkisz (Continued)

FOREIGN PATENT DOCUMENTS

CA 2533046 A1 2/2005
CA 2533236 A1 8/2006

(Continued)

OTHER PUBLICATIONS

U.S. Appl. No. 29/687,781, filed Apr. 16, 2019.

*Primary Examiner* — Chun Hoi Cheung
*Assistant Examiner* — Brijesh V. Patel
(74) *Attorney, Agent, or Firm* — Baker Botts L.L.P.

(57) ABSTRACT

Tamper-evident plastic container comprises a base portion having a sidewall and a base flange, and a lid portion having a lid tab joined to the base flange by a hinge, wherein the lid portion has an open and a closed position. The lid portion is configured to lockingly engage the base portion in the closed position. One of the base flange or the lid tab has a non-linear path of weakness formed therein to define a frangible connection, wherein the frangible connection is configured to be ruptured to initially open the lid portion from the closed position. The non-linear path of weakness is spaced from the hinge to define a tamper indicator region between the non-linear path of weakness and the hinge, wherein the tamper indicator region remains joined to the hinge after the frangible connection is ruptured. Methods of containing a product in a tamper-evident container are also disclosed.

16 Claims, 8 Drawing Sheets

(56) References Cited

U.S. PATENT DOCUMENTS 5,758,791 A 6/1998 Mangla
5,897,011 A 4/1999 Brilliant et al.
5,938,068 A * 8/1999 Atkins ..... B65D 75/22 220/266
6,269,969 B1 8/2001 Huang et al.
6,609,623 B2 8/2003 Chou
6,651,813 B2 * 11/2003 Vallans ..... A61B 50/362 206/365
7,073,680 B2 7/2006 Boback et al.
7,118,003 B2 10/2006 Sellari et al.
7,712,626 B2 5/2010 Vovan
7,992,743 B2 8/2011 Vovan
D646,563 S 10/2011 Bontrager et al.
8,251,249 B1 8/2012 Vovan
8,360,262 B2 1/2013 Vovan
D675,517 S 2/2013 Garza
8,608,008 B2 12/2013 Gingras et al.
8,795,580 B2 8/2014 Sellari et al.
8,833,589 B2 9/2014 Vovan
8,939,307 B2 1/2015 Gingras et al.
9,016,503 B2 * 4/2015 Barbier ..... B65D 43/162 220/270
9,132,942 B2 9/2015 Nikaein
9,242,769 B2 1/2016 Gartz et al.
9,365,331 B2 6/2016 Gingras et al.
9,409,683 B2 8/2016 Gingras et al.
9,493,277 B2 11/2016 Parikh et al.
9,527,640 B2 12/2016 Sellari et al.
9,624,009 B2 4/2017 Gingras et al.
9,630,756 B2 4/2017 Sellari et al.
9,944,436 B2 * 4/2018 Kalmanides ..... B65D 43/0237
D876,222 S 2/2020 Carr et al.
2006/0289549 A1 12/2006 Vovan
2010/0102074 A1 4/2010 Parikh et al.
2012/0067009 A1 3/2012 Bontrager et al.
2013/0160406 A1 * 6/2013 Johnston ..... B65D 43/16 53/467
2015/0060455 A1 * 3/2015 Chou ..... B65D 77/2016 220/270
2015/0298853 A1 10/2015 Chen
2015/0307239 A1 10/2015 Chen
2016/0016707 A1 1/2016 Sellari et al.
2016/0096663 A1 * 4/2016 Lotfi ..... B65D 17/04 220/266
2016/0236837 A1 8/2016 Malcolm
2017/0001401 A1 * 1/2017 Dais ..... B29C 65/08
2017/0001766 A1 1/2017 Cimmerer et al.
2017/0233156 A1 * 8/2017 Shukla ..... B65D 75/367 206/469
2018/0118421 A1 * 5/2018 Allers ..... B65D 43/0254
2018/0170629 A1 6/2018 Phan et al.
2020/0055642 A1 2/2020 Barbier et al.

FOREIGN PATENT DOCUMENTS

CA 2748213 A1 2/2012
CA 3003184 A1 2/2012
GB 2412651 A * 10/2005 ..... B65D 43/0272
WO WO 2005/009857 A1 2/2005
WO WO-2010038080 A1 * 4/2010 ..... B26F 1/22

* cited by examiner

TAMPER-EVIDENT PLASTIC CONTAINER

BACKGROUND OF THE DISCLOSED SUBJECT MATTER

Field of the Disclosed Subject Matter

The disclosed subject matter relates to containers and methods for containing a product, wherein the container has a tamper-evident feature.

Description of the Related Art

A variety of plastic containers for containing a product are employed for the packaging, shipping, storage, and sale of products, such as food products and perishables. A concern among buyers of such products is that the container might have been opened after being packaged by, for example, the manufacturer of the product or the store at which the product is being sold. A variety of features have been developed to indicate whether the container has been opened from its initial closed condition. However, such tamper-evident features often result in or require the removal of material, which results in unnecessary waste. Furthermore, conventional tamper-evident features often do not provide a clear or visible indication to the consumer that the container has been opened, without closer inspection.

There thus remains a continued need for an efficient and economic system for providing a tamper-evident plastic container.

SUMMARY OF THE DISCLOSED SUBJECT MATTER

The purpose and advantages of the disclosed subject matter will be set forth in and are apparent from the description that follows, as well as will be learned by practice of the disclosed subject matter. Additional advantages of the disclosed subject matter will be realized and attained by the devices particularly pointed out in the written description and claims hereof, as well as from the appended drawings.

To achieve these and other advantages and in accordance with the purpose of the disclosed subject matter, as embodied and broadly described, the disclosed subject matter includes a tamper-evident plastic container comprising a base portion having a base, and a sidewall extending upwardly from a perimeter of the base to define a compartment, and a base flange extending outwardly from at least a portion of the sidewall. The container includes a lid portion having an outwardly extending lid tab joined to the base flange by a hinge, the lid portion having an open position and a closed position. The lid portion is configured to lockingly engage the base portion in the closed position. Furthermore, one of the base flange and the lid tab has a non-linear path of weakness formed therein to define a frangible connection, wherein the frangible connection is configured to be ruptured to initially open the lid portion from the closed position. The non-linear path of weakness is spaced from the hinge to define a tamper indicator region between the non-linear path of weakness and the hinge, wherein the tamper indicator region remains joined to the hinge after the frangible connection is ruptured.

As disclosed herein, the non-linear path of weakness can have a waveform pattern in plan view. As embodied herein, the non-linear path of weakness can comprise a plurality of discrete connection regions spaced along a length of the non-linear path of weakness. For example, the plurality of discrete connection regions can be equally spaced along the non-linear path of weakness by a distance corresponding to 360 degrees of the waveform pattern. As embodied herein, the plurality of discrete connection regions can be disposed between opposing peaks of the waveform pattern along the non-linear path of weakness. Additionally, or alternatively, the non-linear path of weakness can comprise a plurality of perforations with the plurality of connection regions disposed therebetween.

As further disclosed herein, the hinge can include a hinge member having a first hinge line joined to the base flange and a second hinge line joined to the lid tab. Furthermore, the non-linear path of weakness can be formed in the lid tab, and the lid portion can further comprise at least one grip tab. Two or more of the plurality of discrete connection regions can be separated by a distance corresponding to approximately 360-380 degrees of the waveform pattern and the first hinge line and the second hinge line can each comprise one or more slits.

In accordance with another aspect of the disclosed subject matter, the disclosed subject matter can include a method of containing a product in a container. The method includes providing a tamper-evident plastic container comprising a base portion having a base, a sidewall extending upwardly from a perimeter of the base to define a compartment, and a base flange extending outwardly from at least a portion of the sidewall. The container includes a lid portion having an outwardly extending lid tab joined to the base flange by a hinge. The lid portion has an open position and a closed position. The lid portion is configured to lockingly engage the base portion in the closed position. The container includes one of the base flange and the lid tab having a non-linear path of weakness formed therein to define a frangible connection, wherein the frangible connection is configured to be ruptured to initially open the lid portion from the closed position. The non-linear path of weakness is spaced from the hinge to define a tamper indicator region between the non-linear path of weakness and the hinge. The tamper indicator region remains joined to the hinge after the frangible connection is ruptured. The method includes disposing a product within the compartment and lockingly engaging the lid portion and the base portion in the closed position.

It is to be understood that both the foregoing general description and the following detailed description and drawings are examples and are provided for purpose of illustration and not intended to limit the scope of the disclosed subject matter in any manner.

The accompanying drawings, which are incorporated in and constitute part of this specification, are included to illustrate and provide a further understanding of the devices of the disclosed subject matter. Together with the description, the drawings serve to explain the principles of the disclosed subject matter.

BRIEF DESCRIPTION OF THE DRAWINGS

The subject matter of the application will be more readily understood from the following detailed description when read in conjunction with the accompanying drawings, in which.

Figure 1:
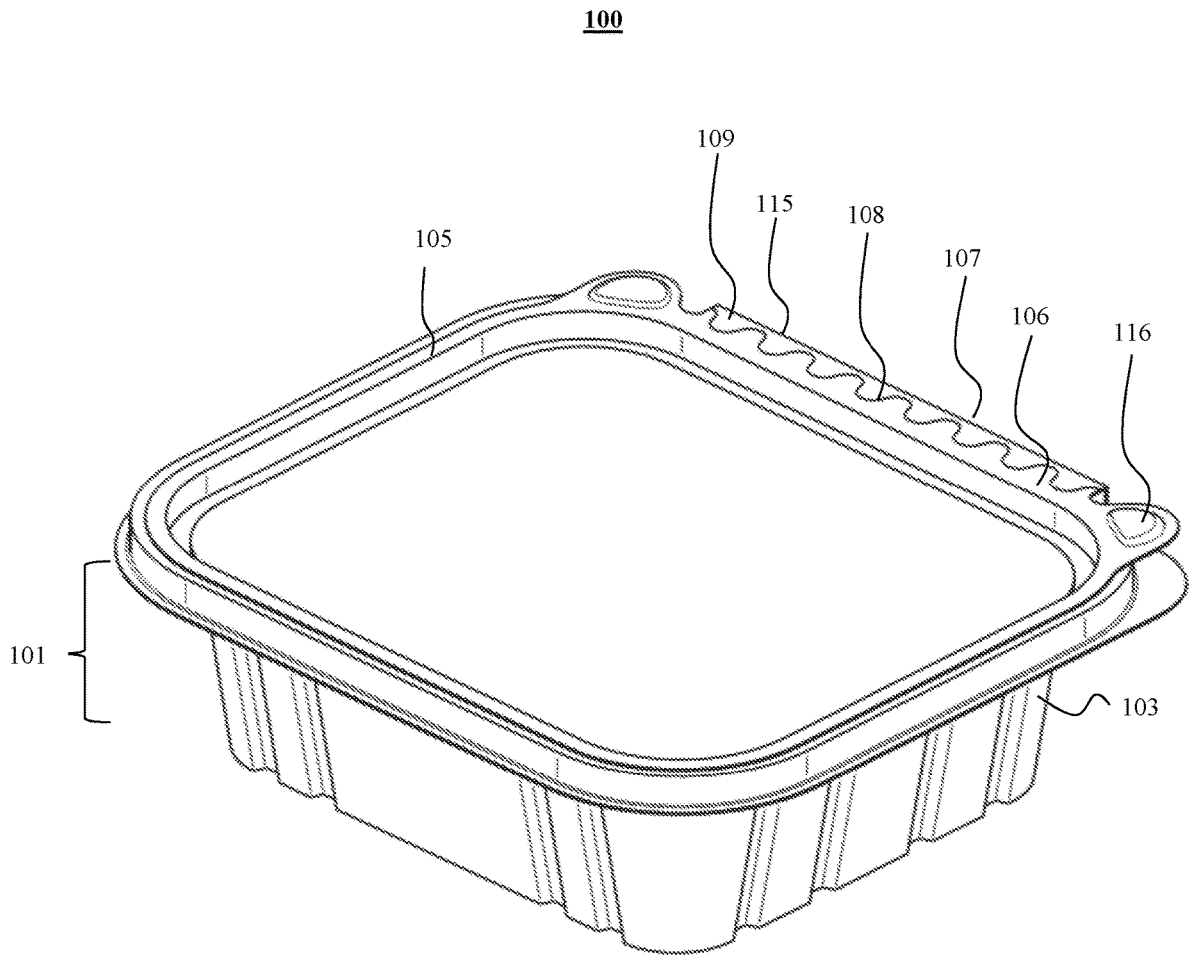
FIG. 1 is a front perspective view of an exemplary tamper-evident plastic container of the disclosed subject matter in a closed position.
Figure 5A:
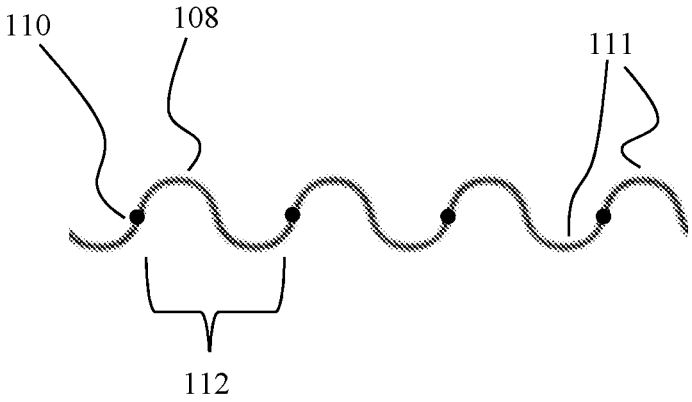
FIG. 5A is a detail plan view of an exemplary non-linear path of weakness of the tamper-evident plastic container of the disclosed subject matter, such as for the container of FIG. 1.
Figure 5B:
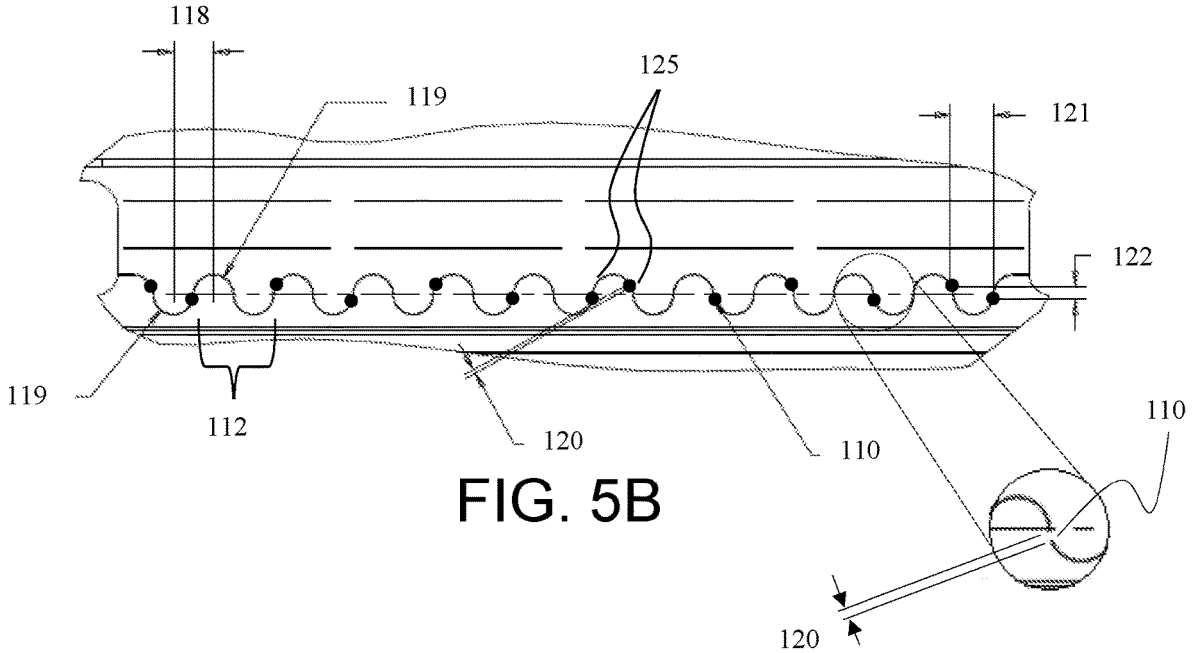
Figure 5C:
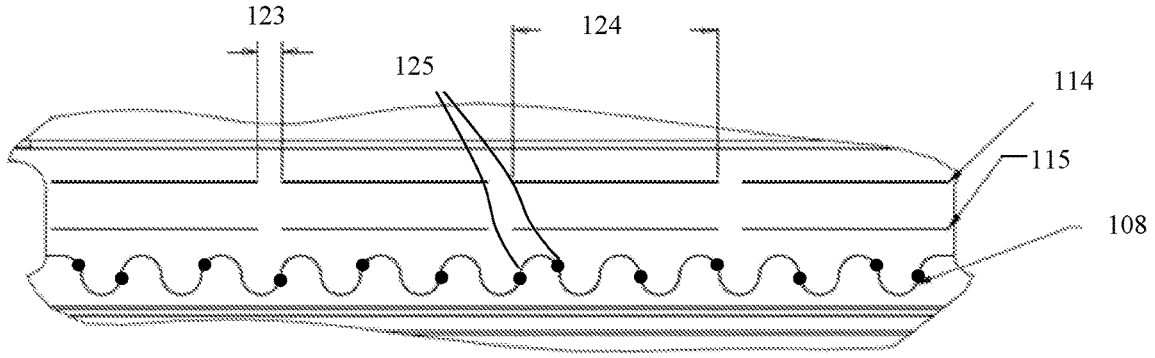

Each of FIGS. 5B and 5C is a detail plan view of an exemplary non-linear path of weakness and exemplary hinge lines of the tamper-evident plastic container of the disclosed subject matter, such as for the container of FIG. 1.

Figure 6:
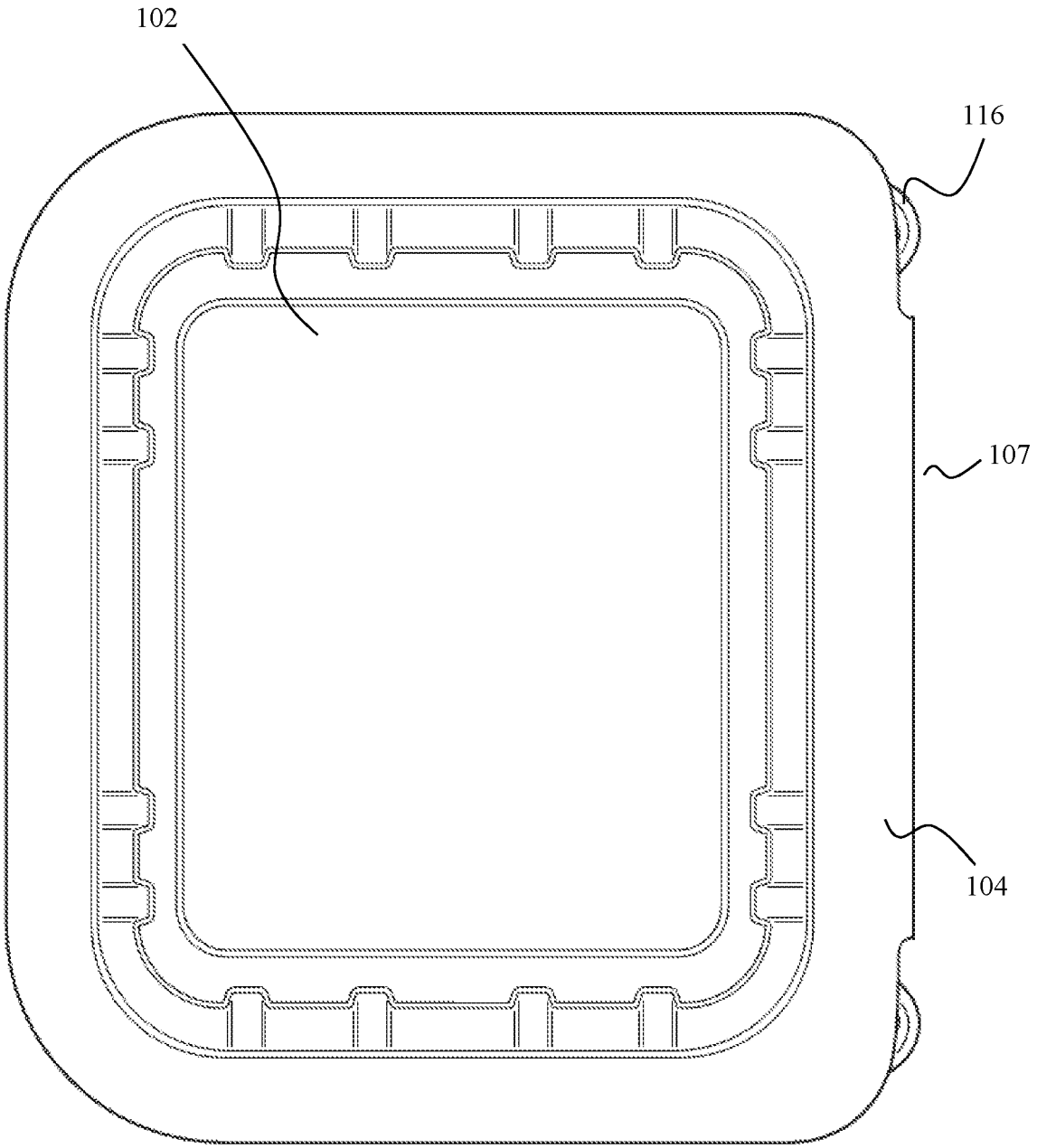

FIG. 6 is a bottom view of the exemplary tamper-evident plastic container of FIG. 1 in a closed position.

Figure 7:
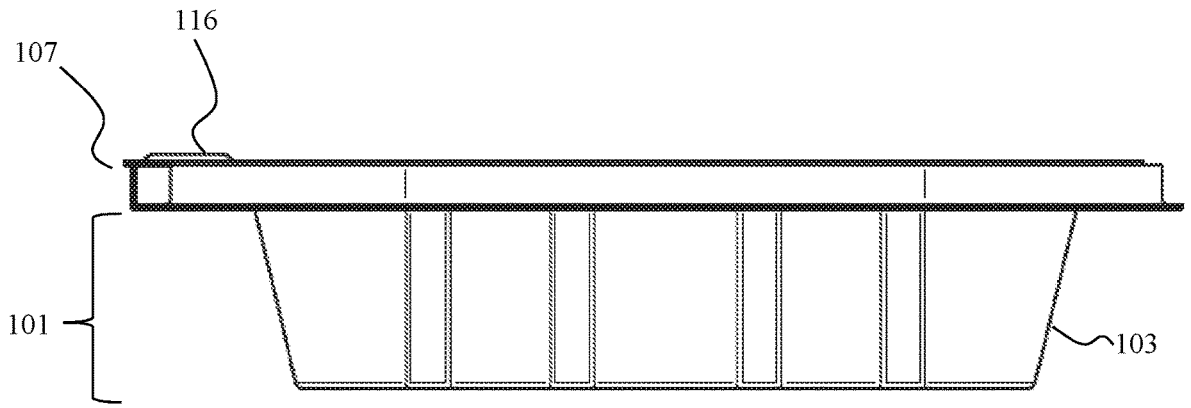

FIG. 7 is a side view of the exemplary tamper-evident plastic container of FIG. 1 in a closed position.

Figure 8:
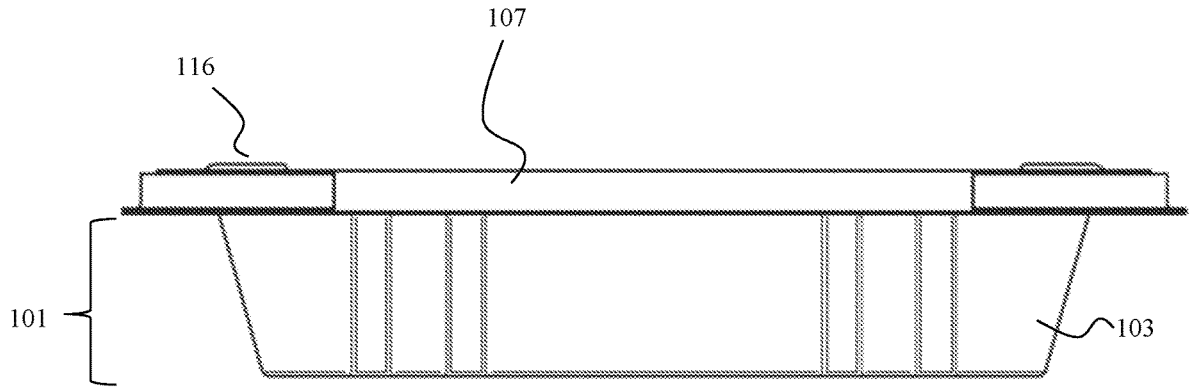

FIG. 8 is a front view of the exemplary tamper-evident plastic container of FIG. 1 in a closed position.

DETAILED DESCRIPTION

Reference will now be made in detail to embodiments of the disclosed subject matter, an example of which is illustrated in the accompanying drawings. The disclosed subject matter will be described in conjunction with the detailed description of the system.

As disclosed herein, the containers presented herein can be used, for example, for packaging various products, such as food products and perishables, in a tamper-evident manner, as well as a method of containing a product in such a plastic container.

In accordance with the disclosed subject matter, a tamper-evident plastic container is provided. The plastic container disclosed herein includes a base portion having a base, a sidewall extending upwardly from a perimeter of the base to define a compartment, and a base flange extending outwardly from at least a portion of the sidewall. The plastic container has a lid portion having an outwardly extending lid tab joined to the base flange by a hinge. The lid portion has an open position and a closed position, and the lid portion is configured to lockingly engage the base portion in the closed position. One of the base flange and the lid tab of the plastic container disclosed herein has a non-linear path of weakness formed therein to define a frangible connection, wherein the frangible connection is configured to be ruptured to initially open the lid portion from the closed position. The non-linear path of weakness is spaced from the hinge to define a tamper indicator region between the non-linear path of weakness and the hinge, and the tamper indicator region remains joined to the hinge after the frangible connection is ruptured.

Solely for purpose of illustration, and not limitation, an exemplary embodiment of a tamper-evident plastic container is shown schematically in FIGS. 1-8. The examples herein are not intended to limit the scope of the disclosed subject matter in any manner. Particularly, and as illustrated, the disclosed subject matter provides a tamper-evident plastic container 100.

As illustrated, and with reference to FIGS. 1-8, the tamper-evident plastic container 100 disclosed herein includes a base portion 101 having a base 102 that defines a support surface for the container. Base portion 101 further includes a sidewall 103 extending upwardly from a perimeter of the base 102 to define a compartment 117 for the container. Further, base portion 101 includes a base flange 104 extending outwardly from at least a portion of the sidewall 103. Although depicted as a generally rectangular shape, base portion 101 can be provided with a variety of suitable shapes and sizes. For example, the base portion can be circular, oval, triangular, polygonal, or other suitable shape in plan view. For example, but certainly not by limitation, the base portion can be formed in a manner as in U.S. Pat. No. 8,833,589, the disclosure of which is hereby incorporated by reference in its entirety. Likewise, the sidewall can be generally perpendicular or trapezoidal in side view, or can be curved to form a bowl shape, or can comprise a combination thereof. Additionally, or alternatively, the base flange can be generally planar or provided with a channel shape in cross-section to form a locking feature as known in the art.

The plastic container 100 further has a lid portion 105 having an outwardly extending lid tab 106. Lid tab 106 is joined to the base flange by a hinge 107. The lid portion 105 can have an open position, as shown, for example, in FIG. 3, and a closed position, shown for example and not by way of limitation, in FIG. 1. Additionally, the lid portion 105 is configured to lockingly engage the base portion 101 in the closed position, as shown, for example and not limitation, in FIG. 1. As embodied herein, the lid portion 105 can be configured to lockingly engage the base portion 101 in a number of ways, including for example, but not limitation, by a snap-fit arrangement, utilizing channels or other locking elements, or a combination thereof as known in the art and as disclosed, for example, in U.S. Pat. No. 9,242,769, the disclosure of which is hereby incorporated by reference in its entirety. For example, and with reference to FIGS. 1, 2, and 4, lid portion 105 can be configured to lockingly engage within a channel of the base portion 101, the channel being formed by a raised portion extending at least partially around the perimeter of the base portion 101, such that at least part of the lid portion 105 can be secured within the channel in a closed position. Thus, the raised portion of the base portion 101 can protect the at least part of the lid portion 105 from being released from the channel after the lid portion 105 is lockingly engaged with the base portion 101. Although disclosed as generally having a rectangular shape, lid portion 105 can be provided with a variety of suitable shapes and sizes. For example, the lid portion 105 can be circular, oval, triangular, polygonal, or other suitable shape in plan view. Additionally, or alternatively, lid portion 105 can be formed in a domed shape so as to provide extra volume for the container. The domed shape can be formed outwardly relative to the compartment, for example and not limitation, in a circular, oval, rectangular, or polyhedron shape. Likewise, the lid tab can be generally formed in a rectangular, trapezoidal, or other suitable shape, for example but certainly not limitation, as disclosed in U.S. Pat. No. 8,360,262, the disclosure of which is hereby incorporated by reference in its entirety.

Further in accordance with the disclosed subject matter, one of the base flange 104 and the lid tab 106 of the plastic container disclosed herein is provided with a non-linear path of weakness 108 formed therein, and defining a frangible connection. Particularly, the frangible connection is configured to be ruptured to initially open the lid portion from the closed position. Additionally, the non-linear path of weakness 108 is spaced from the hinge 107 to define a tamper indicator region 109 between the non-linear path of weakness 108 and the hinge 107, wherein the tamper indicator region 109 remains joined to the hinge 107 after the frangible connection is ruptured. For example and not limitation, the exemplary container embodied herein has a non-linear path of weakness 108 provided on the lid tab. Thus, to initially open the lid from the closed position, the non-linear path of weakness is ruptured such that tamper indicator region 109 extends upwardly as shown, for example, in FIG. 2. Thus, as embodied herein, and with reference to FIG. 2, once the frangible connection is ruptured, tamper indicator region 109 can serve as a flag or indicator that the tamper-evident plastic container 100 was once lockingly closed, but has since been opened or tampered with.

Alternatively, and not by way of limitation, the non-linear path of weakness 108 can be provided in the base flange 104, forming a frangible connection therein. In a similar manner as noted above for configurations of the disclosed subject matter in which the non-linear path of weakness 108 is formed in the lid tab 106, the non-linear path of weakness 108 can be spaced from the hinge 107, and the tamper indicator region 109 can remain joined to the hinge 107 after the frangible connection is ruptured so as to extend downwardly from the base flange.

A variety of non-linear path of weakness configurations can be provided in accordance with the disclosed subject matter. For example, and as disclosed herein, the non-linear path of weakness 108 can have a waveform pattern in plan view, suitable waveform patterns including, for example, square, sinusoidal, sawtooth, or triangular waveform patterns. Additionally, or in the alternative, the non-linear path of weakness 108 can have an irregular waveform pattern. The non-linear path of weakness 108 can have a generally rounded shape. As embodied herein, for purpose of illustration and not limitation, a non-linear path of weakness having a sinusoidal shape is provided as shown in FIGS. 1-5C. As embodied herein, the sinusoidal shape of the non-linear path of weakness 108 can have a radius of curvature 119 of approximately 0.120 inches.

The non-linear path of weakness 108 can be formed, for example, by a score line, groove, or by otherwise weakening the nature of the container. Additionally or alternatively, the non-linear path of weakness 108 can be defined by a non-continuous line of weakness so as to define a plurality of discrete connection regions 110. As embodied herein, and as shown in detail view in FIG. 5A, the non-linear path of weakness can have a plurality of discrete connection regions 110 spaced along a length of the non-linear path of weakness 108. The connection regions can include portions of the same material of the container joining the two sides of the lid tab 106 that are divided by the non-linear path of weakness 108 prior to rupture of the frangible connection formed by the non-linear path of weakness 108. As embodied herein, the plurality of discrete connection regions 110 can be periodically or equally spaced along the non-linear path of weakness 108, for example, by a distance corresponding to about 360 degrees of the waveform pattern as depicted in FIG. 5A. Additionally, or alternatively, the connection regions 110 can be spaced along the non-linear path of weakness 108 by a distance corresponding to about 180 degrees of a waveform pattern. The plurality of discrete connection regions 110 can be disposed between opposing peaks 111 of the waveform pattern along the non-linear path of weakness 108 so that no bumps or chads are exposed along the tamper indicating region after rupture of the non-linear path of weakness. Additionally, or alternatively, the non-linear path of weakness can comprise a plurality of perforations 112 with the plurality of connection regions 110 disposed therebetween, such as continuously along the length of the non-linear path of weakness or along selected segments thereof. As embodied herein, connection regions 110 can have a length 120 measuring between about 19% and 21%, or approximately ⅕ of the radius of curvature 119 of the non-linear path of weakness 108. For example, length 120 can be about 0.023 inches.

In accordance with another aspect of the disclosed subject matter, the connection regions 110 can be configured so that in an unopened configuration, the tamper indicator region 109 and the lid tab 106 form a substantially flat surface. In this manner, the package is configured to clearly show that the package has been sealed and has not been opened or tampered with. For example, and with reference to FIGS. 5B and 5C, two or more connection regions 110 can be spaced along the non-linear path of weakness 108 by a distance corresponding to about 360-380 degrees of a waveform pattern, wherein each connection region 110 is spaced on one side or another of a reference axis of the non-linear path of weakness 108, in an alternating pattern. For example, connection regions 110 can be placed along the non-linear path of weakness 108 such that transverse offset 122 separates connection regions 110 that lie on either side of the reference axis. For example, transverse offset 122 can be approximately 0.080 inches. As embodied herein, and as depicted in the detail view of FIG. 5B, connection regions 112, which are otherwise depicted as dots, can include portions of the same material of the container, disposed between two perforations, forming the non-linear path of weakness 108.

Additionally, or alternatively, a pair of connection regions 110 at each end of the non-linear path of weakness 108 can be spaced apart by a distance corresponding to less than 360 degrees of a waveform pattern. For example, the pair of connection regions 110 at each end can be separated by a distance 121 corresponding to about 180-200 degrees of a waveform pattern. Additionally, or alternatively, a pair of connection regions 110 (denoted by numeral 125) can be separated by a distance corresponding to less than 180 degrees of a waveform pattern. For example, a distance 118 corresponding to approximately 180 degrees of the waveform pattern of the non-linear path of weakness 108 can be about 0.245 inches, and the distance 121 can be about 0.266 inches.

In accordance with another aspect of the disclosed subject matter, and with reference to FIGS. 5B and 5C, connection regions 110 along the non-linear path of weakness can be separated by one or more of a distance corresponding to less than 180 degrees of a waveform pattern, a distance corresponding to about 180-200 degrees of a waveform pattern, a distance corresponding to about 340-360 degrees of a waveform pattern, a distance corresponding to about 360 degrees of a waveform pattern, and a distance corresponding to about 360-380 degrees of a waveform pattern. In addition, or alternatively, connection regions 110 can be separated, in one or more alternating patterns, by a distance corresponding to about 340-360 degrees of a waveform pattern and a distance corresponding to about 360-380 degrees of a waveform pattern. In other words, for example, two or more perforations 112 between connection regions 110 can be sized according to an alternating pattern, in which a first perforation 112 has a length corresponding to about 360-380 degrees of a waveform pattern and a second perforation 112 has a length corresponding to about 340-360 degrees of a waveform pattern.

In accordance with another aspect of the disclosed subject matter, and with reference to FIGS. 5B and 5C, to further facilitate the formation of a flat surface by the tamper indicator region 109 and the lid tab 106 in an unopened configuration, the transverse offset 122 separating connecting regions 110 on either side of the reference axis can be configured such that the majority of the offset lies on one side of the reference axis of the non-linear path of weakness 108, such that connection regions 110 placed on one side of the reference axis are placed closer to the reference axis than the connection regions 110 that are placed on the opposite side of the reference axis. For example, the reference axis of the non-linear path of weakness can be a centerline of the non-linear path of weakness.

As embodied herein, the hinge 107 can include hinge member 113, including a first hinge line 114 joined to the base flange 104 and a second hinge line 115 joined to the lid tab 106. The hinge lines 114 and 115 can be formed by score lines, grooves, perforations, or other known living hinge configurations.

In accordance with another aspect of the disclosed subject matter, hinge lines 114 and 115 can be configured as slit hinges to create tension such that upon opening, tamper indicator region 109 extends upward to clearly indicate that the product has been opened. For example, hinge lines 114 and 115 can be formed by one or more slits cut through the material of the container, that are spaced from one another and substantially parallel with the non-linear path of weakness. For example, hinge lines 114 and 115 can be formed by three slits. Additionally, or alternatively, hinge lines 114 and 115 can be formed by four slits, each measuring a distance 124 of approximately 1.250-1.4750 inches in length and each separated from one another by a distance 123 of approximately 0.150 inches.

To assist with rupturing the non-linear path of weakness 108, and subsequently opening the lid, the lid portion 105 can be provided with at least one grip tab. For example, and as embodied herein with reference to FIGS. 1-4 and 6-8, the at least one grip tab can comprise a first grip tab and a second grip tab, wherein the second grip tab can be disposed opposite the first grip tab with respect to the lid tab 106. The grip tab can be disposed proximate the non-linear path of weakness 108 and can extend beyond the base flange 104 when the lid portion is in the closed position as shown for example in FIG. 4. For example, and not by way of limitation, the grip tabs can extend beyond the base flange 104 at least by approximately 1/16 inch.

In accordance with another aspect of the disclosed subject matter, and with reference to FIGS. 1-4 and 6-8, at least a portion of one or more grip tabs 116 can be aligned with, such as in a generally collinear configuration with respect to, a centerline of the non-linear path of weakness 108. In this manner, the one or more grip tabs 116 can facilitate the rupturing of the non-linear path of weakness by a user. For example, the one or more grip tabs can be configured such that to open the container, a user's grip placement is aligned with a centerline of the non-linear path of weakness. The one or more grip tabs can thereby be configured so that the opening of the container using the one or more grip tabs causes rupturing of the non-linear path of weakness rather than a hinge.

In accordance with the embodiments of the disclosed subject matter, the tamper-evident plastic container can be made out of one or more of a plurality of suitable materials. For example, the container can be formed from polystyrene foam, oriented polystyrene (OPS), polypropylene, mineral filled polypropylene, amorphous polyethylene terephthalate (APET), thermoplastics, and paper, as known in the art, and/or as disclosed for example by U.S. Pat. No. 9,242,769, the disclosure of which, as noted above is incorporated by reference herein. As embodied herein, the disclosed container is formed of APET. Additionally, as embodied herein, the disclosed container can be formed by a number of methods, including for example but not limitation by thermoforming, stamping, molding, or other suitable process as known in the art and/or as disclosed by U.S. Pat. No. 9,242,769, the disclosure of which, as noted above, is incorporated by reference herein. As embodied herein, the disclosed container is formed by thermoforming.

In accordance with another aspect of the disclosed subject matter, the disclosed subject matter includes a method of containing a product in a container. The method includes providing a tamper-evident plastic container having a base portion with a base. A sidewall extends upwardly from a perimeter of the base to define a compartment, and a base flange extends outwardly from at least a portion of the sidewall. The container includes a lid portion having an outwardly extending lid tab joined to the base flange by a hinge. the lid portion has an open position, as shown, for example, in FIG. 3. The lid portion has a closed position, as shown, for example, in FIGS. 1, 4, and 6-8. The lid portion is configured to lockingly engage the base portion in the closed position. The container includes one of the base flange or the lid tab having a non-linear path of weakness formed therein to define a frangible connection, and the frangible connection is configured to be ruptured the first time that the lid portion is opened from the closed position. the non-linear path of weakness is spaced from the hinge to define a tamper indicator region between the non-linear path of weakness and the hinge. The method further includes disposing a product within the compartment and lockingly engaging the lid portion and the base portion in the closed position.

Figure 2:
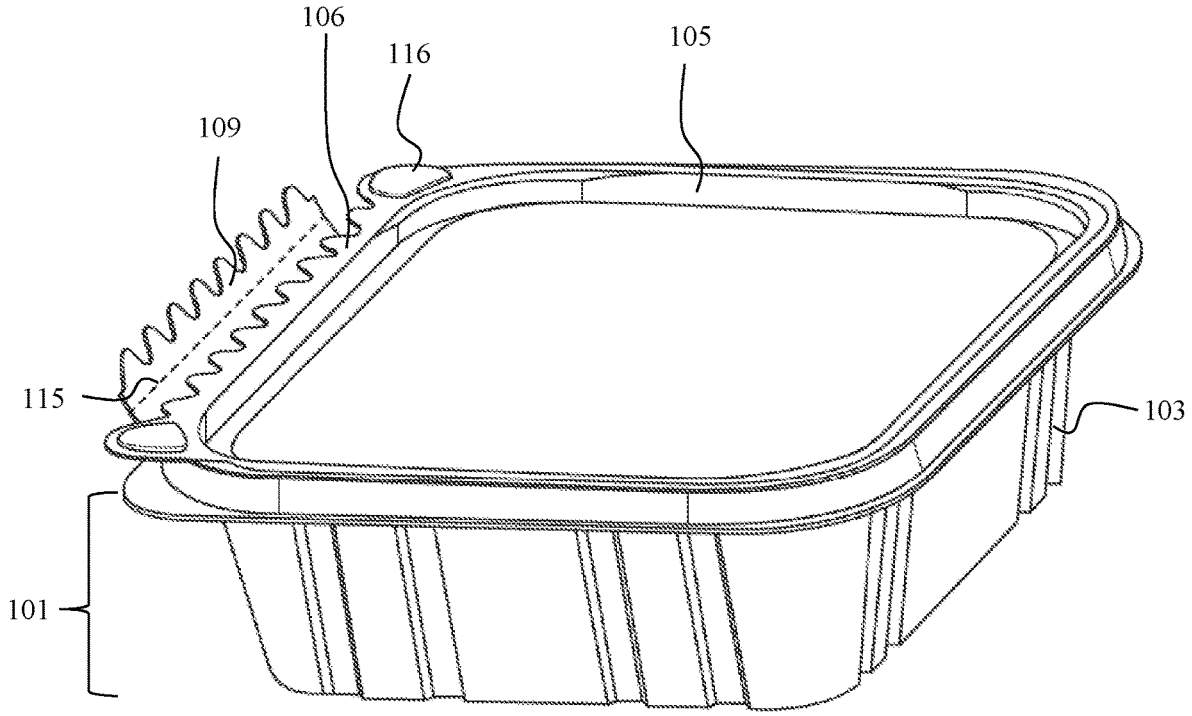
FIG. 2 is a side perspective view of the exemplary tamper-evident plastic container of FIG. 1, showing the frangible connection after having been ruptured.
Figure 3:
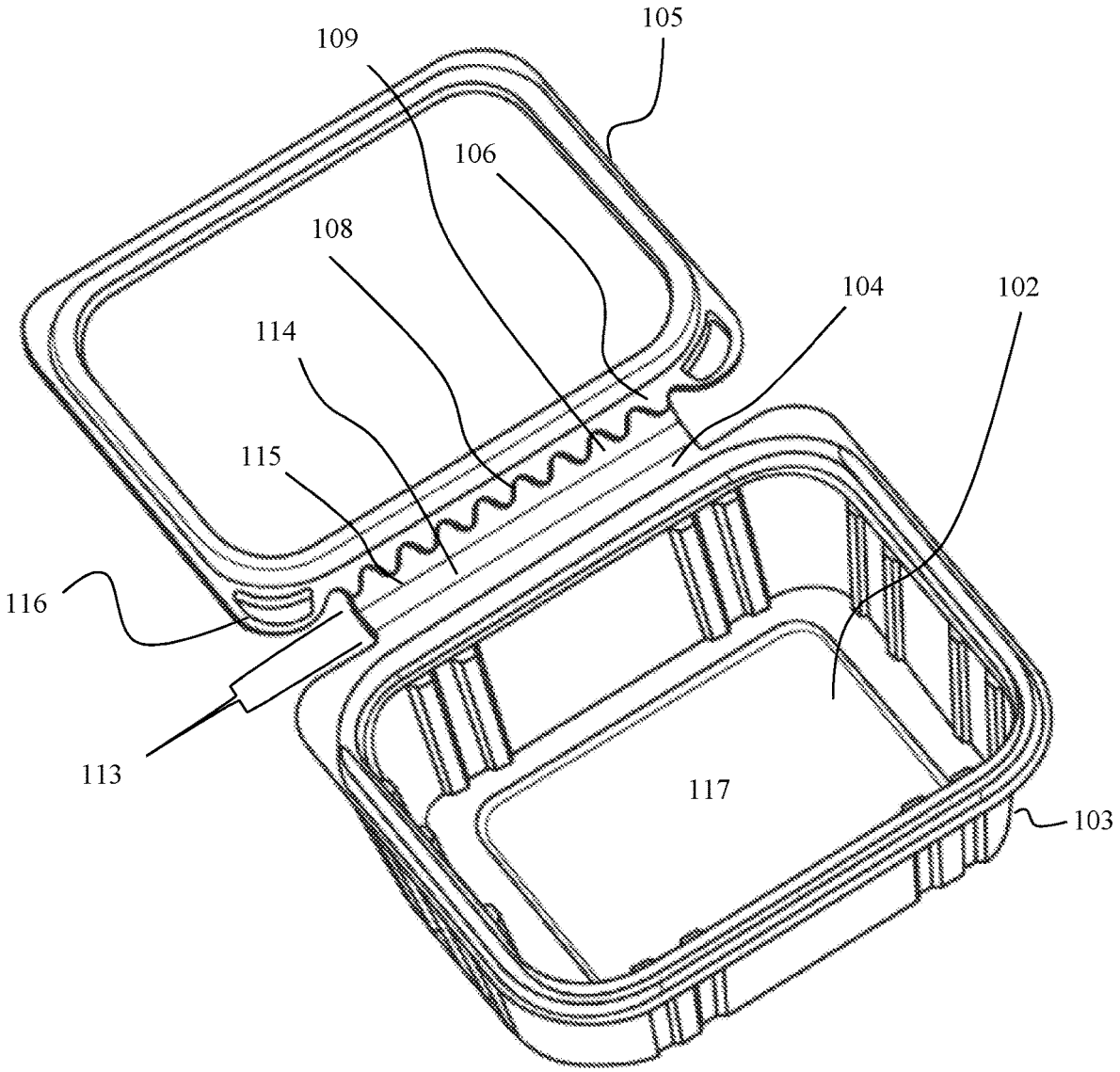
FIG. 3 is a top perspective view of the exemplary tamper-evident plastic container of FIG. 1 in an open position.
Figure 4:
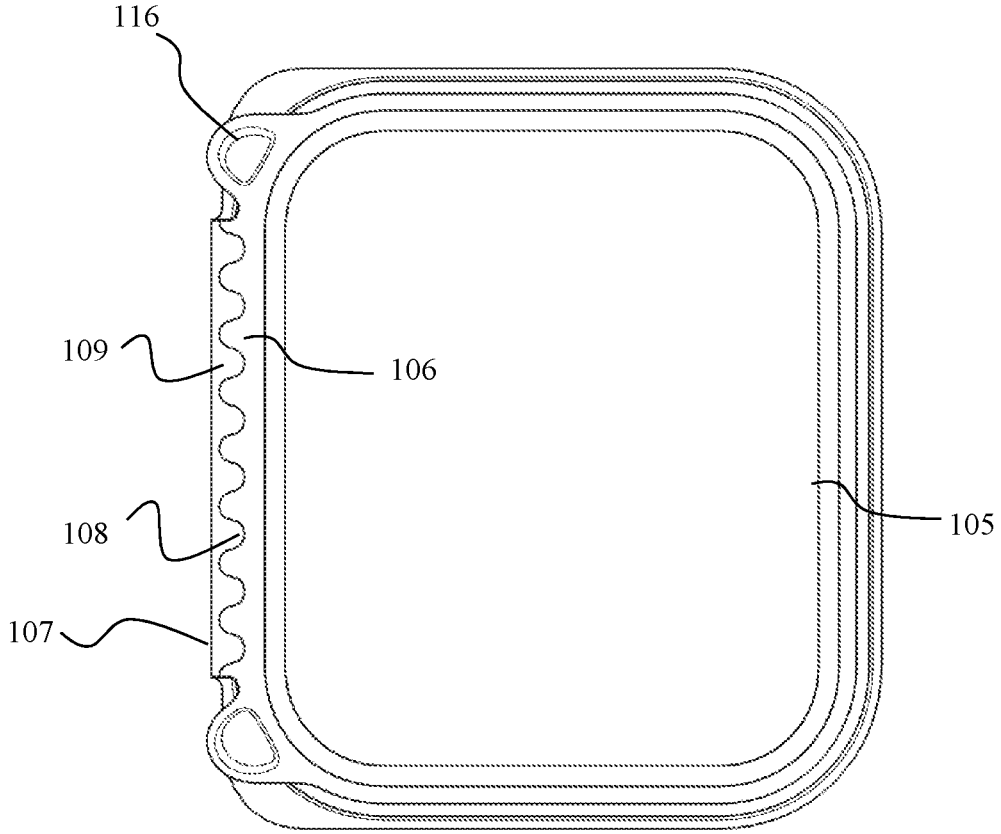
FIG. 4 is a top view of the exemplary tamper-evident plastic container of FIG. 1 in a closed position.

As embodied herein, and with reference to FIG. 2, the tamper indicator region remains joined to the hinge after the frangible connection is ruptured, and the tamper indicator region thereafter serves as a visual indicator that the package has since been opened or tampered with after being lockingly closed. Accordingly, the disclosed subject matter includes the methods of using the container as described herein.

While the disclosed subject matter is described herein in terms of certain preferred embodiments, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the apparatus and method of the disclosed subject matter without departing from the spirit or scope of the disclosed subject matter. Thus, it is intended that the disclosed subject matter include modifications and variations that are within the scope of the appended claims and their equivalents.

What is claimed is:

1. A tamper-evident plastic container comprising:

a base portion having a base, a sidewall extending upwardly from a perimeter of the base to define a compartment, and a base flange extending outwardly from at least a portion of the sidewall; and a lid portion having an outwardly extending lid tab joined to the base flange by a hinge, the lid portion having an open position and a closed position, the lid portion being configured to lockingly engage the base portion in the closed position;

one of the base flange and the lid tab having a non-linear path of weakness formed therein to define a frangible connection, wherein the frangible connection is configured to be ruptured to initially open the lid portion from the closed position, the non-linear path of weakness being spaced from the hinge to define a tamper indicator region between the non-linear path of weakness and the hinge, the tamper indicator region remaining joined to the hinge after the frangible connection is ruptured; and further wherein the non-linear path of weakness has a waveform pattern in plan view, the non-linear path of weakness comprising a plurality of discrete connection regions along a length of the non-linear path of weakness with each discrete connection region spaced from opposing peaks of the waveform pattern and with no discrete connection regions at the opposing peaks of the waveform pattern.

2. The tamper-evident plastic container of claim 1, wherein the plurality of discrete connection regions are equally spaced along the non-linear path of weakness by a distance corresponding to 360 degrees of the waveform pattern.

3. The tamper-evident plastic container of claim 1, wherein the non-linear path of weakness comprises a plurality of perforations with the plurality of discrete connection regions disposed therebetween.

4. The tamper-evident plastic container of claim 1, wherein two or more of the plurality of discrete connection regions are separated by a distance corresponding to 360-380 degrees of the waveform pattern.

5. The tamper-evident plastic container of claim 1, wherein the hinge includes a hinge member having a first hinge line joined to the base flange and a second hinge line joined to the lid tab.

6. The tamper-evident plastic container of claim 5, wherein the first hinge line and the second hinge line each comprises one or more slits.

7. The tamper-evident plastic container of claim 1, wherein the non-linear path of weakness is formed in the lid tab, the lid portion further comprising at least one grip tab.

8. The tamper-evident plastic container of claim 1, wherein the waveform pattern of the non-linear path of weakness is a sinusoidal waveform pattern.

9. A method of containing a product in a container, comprising:

providing a tamper-evident plastic container comprising:

a base portion having a base, a sidewall extending upwardly from a perimeter of the base to define a compartment, and a base flange extending outwardly from at least a portion of the sidewall, and a lid portion having an outwardly extending lid tab joined to the base flange by a hinge, the lid portion having an open position and a closed position, the lid portion being configured to lockingly engage the base portion in the closed position, one of the base flange and the lid tab having a non-linear path of weakness formed therein to define a frangible connection, wherein the frangible connection is configured to be ruptured to initially open the lid portion from the closed position, the non-linear path of weakness being spaced from the hinge to define a tamper indicator region between the non-linear path of weakness and the hinge, the tamper indicator region remaining joined to the hinge after the frangible connection is ruptured, and further wherein the non-linear path of weakness has a waveform pattern in plan view, the non-linear path of weakness comprising a plurality of discrete connection regions along a length of the non-linear path of weakness with each discrete connection region spaced from opposing peaks of the waveform pattern and with no discrete connection regions at the opposing peaks of the waveform pattern;

disposing a product within the compartment; and lockingly engaging the lid portion and the base portion in the closed position.

10. The method of containing a product in a container of claim 9, wherein the plurality of discrete connection regions are equally spaced along the non-linear path of weakness by a distance corresponding to 360 degrees of the waveform pattern.

11. The method of containing a product in a container of claim 9, wherein the non-linear path of weakness comprises a plurality of perforations with the plurality of discrete connection regions disposed therebetween.

12. The method of containing a product in a container of claim 9, wherein two or more of the plurality of discrete connection regions are separated by a distance corresponding to 360-380 degrees of the waveform pattern.

13. The method of containing a product in a container of claim 9, wherein the hinge includes a hinge member having a first hinge line joined to the base flange and a second hinge line joined to the lid tab.

14. The method of containing a product in a container of claim 13, wherein the first hinge line and the second hinge line each comprises one or more slit.

15. The method of containing a product in a container of claim 9, wherein the non-linear path of weakness is formed in the lid tab, the lid portion further comprising at least one grip tab.

16. The method of containing a product in a container of claim 9, wherein the waveform pattern of the non-linear path of weakness is a sinusoidal waveform pattern.

* * * * *